US005096320A

United States Patent [19]

Norman et al.

[11] Patent Number: 5,096,320

[45] Date of Patent: Mar. 17, 1992

[54] ADJUSTABLE BRUSH CAP APPARATUS

[76] Inventors: Tonya K. Norman; Jackie L. Norman, Jr., both of R.R. #3 Box 359, Tuscola, Ill. 61953

[21] Appl. No.: 612,550

[22] Filed: Nov. 13, 1990

[51] Int. Cl.[5] ..... A46B 11/00

[52] U.S. Cl. ..... 401/127; 401/129

[58] Field of Search ..... 222/187; 401/127, 129, 401/126

[56] References Cited

U.S. PATENT DOCUMENTS

| | | | |
|---|---|---|---|
| 562,134 | 6/1896 | Haner | 401/127 X |
| 4,690,579 | 9/1987 | Tuckman | 401/127 |
| 4,875,602 | 10/1989 | Chickering et al. | 222/187 |
| 4,961,664 | 10/1990 | Simper | 401/127 |
| 4,990,014 | 2/1991 | O'Neill | 401/127 |

FOREIGN PATENT DOCUMENTS

| | | | |
|---|---|---|---|
| 442641 | 8/1967 | Switzerland | 401/127 |

*Primary Examiner*—Michael S. Huppert
*Assistant Examiner*—Gregory L. Huson
*Attorney, Agent, or Firm*—Leon Gilden

[57] ABSTRACT

An apparatus wherein a fluid container mounts a threadedly removable cap, the threadedly removable cap including an internally threaded bottom well for securement to the container, with an upper cap bore mounting a plunger therewithin, the plunger coaxially aligned with the cap and container and mounting a brush rod and brush. The brush is in contact with a floor of the container in a second position displaced from a first position to permit the brush to project interiorly of the container for access to fluid on the floor of the container.

1 Claim, 4 Drawing Sheets

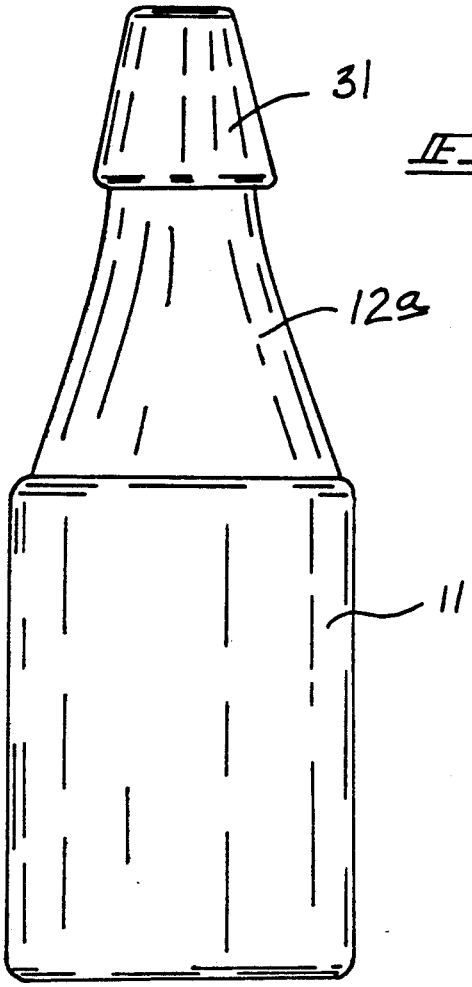
Fig 7
Fig 8
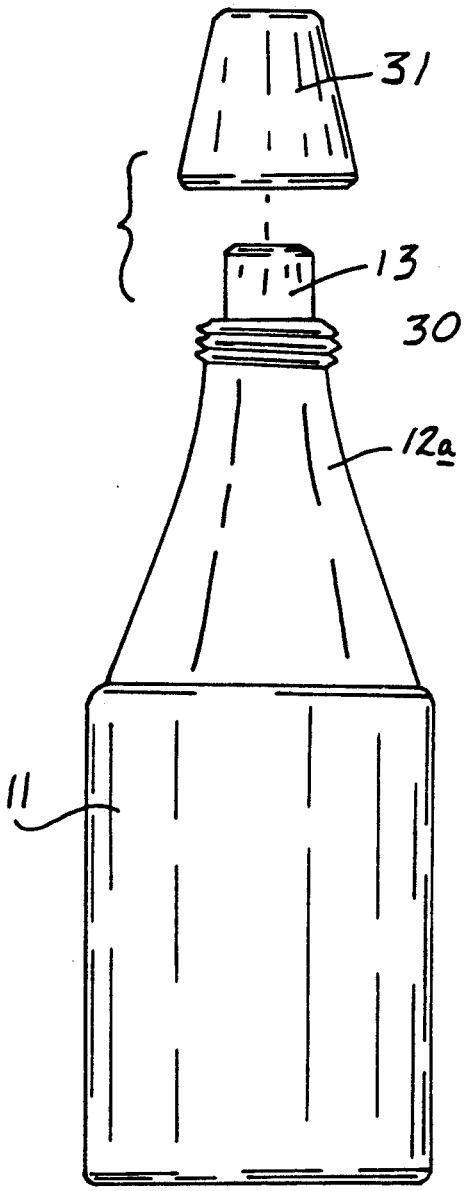

ADJUSTABLE BRUSH CAP APPARATUS

BACKGROUND OF THE INVENTION

1. Field of the Invention

The field of invention relates to applicator brush organizations, and more particularly pertains to a new and improved adjustable brush cap apparatus to permit the brush mounted within the cap to extend for access to fluid contained about a floor of an underlying container.

2. Description of the Prior Art

In use of fluids from containers typically applied by brush, such as nail lacquers and other fluids, the container and its depletion of fluid typically positions the brush applicator in a spaced relationship relative to the floor of the container. Such fluid is typically wasted and discarded. The instant invention attempts to overcome deficiencies of the prior art by providing a cap assembly wherein the brush may be extended in relation to the container floor. Examples of the prior art include U.S. Pat. No. Des. 180,715 to Henry, et al. wherein a container is mounted at an acute angle relative to a support surface to permit a brush access to a floor of the container.

U.S. Pat. No. 3,130,433 to John sets forth a manicuring device mounting a brush assembly relative to a container in a conventional manner.

U.S. Pat. No. Des. 159,797 to Gessler sets forth a further example of a jar structure.

U.S. Pat. No. 2,237,810 to Casper sets forth a pouring spout in association with a container opener.

U.S. Pat. No. 2,314,562 to Sheaffer sets forth a pour-out closure relative to a spout for a container.

As such, it may be appreciated that there continues to be a need for a new and improved adjustable brush cap apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container and brush assemblies now present in the prior art, the present invention provides an adjustable brush cap apparatus wherein the same permits extension of the brush relative to the container interiorly thereof for access of the brush to fluid contained therewithin. As such, the general purpose of the present invention, which will be described subsequently in greater detail, is to provide a new and improved adjustable brush cap apparatus which has all the advantages of the prior art container and brush organizations and none of the disadvantages.

To attain this, the present invention provides an apparatus wherein a fluid container mounts a threadedly removable cap, the threadedly removable cap including an internally threaded bottom well for securement to the container, with an upper cap bore mounting a plunger therewithin, the plunger coaxially aligned with the cap and container and mounting a brush rod and brush. The brush is in contact with a floor of the container in a second position displaced from a first position to permit the brush to project interiorly of the container for access to fluid on the floor of the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable brush cap apparatus which has all the advantages of the prior art container and brush organizations and none of the disadvantages.

It is another object of the present invention to provide a new and improved adjustable brush cap apparatus which may be easily and efficiently manufactured and marketed.

It is a further object of the present invention to provide a new and improved adjustable brush cap apparatus which is of a durable and reliable construction.

An even further object of the present invention is to provide a new and improved adjustable brush cap apparatus which is susceptible of a low cost of manufacture with regard to both materials and labor, and which accordingly is then susceptible of low prices of sale to the consuming public, thereby making such adjustable brush cap apparatus economically available to the buying public.

Still yet another object of the present invention is to provide a new and improved adjustable brush cap apparatus which provides in the apparatuses and methods of the prior art some of the advantages thereof, while simultaneously overcoming some of the disadvantages normally associated therewith.

Still another object of the present invention is to provide a new and improved adjustable brush cap apparatus wherein the same provides for an extensible brush rod mounting a brush at a lower terminal end thereof to permit access of the brush to fluid about a floor of an associated container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic view, taken in elevation, of a modified cap structure utilized by the instant invention.

FIG. 8 is an orthographic view, taken in elevation, of the cap structure with the covering cap removed therefrom.

DESCRIPTION OF THE PREFERRED EMBODIMENT

Figure 1:
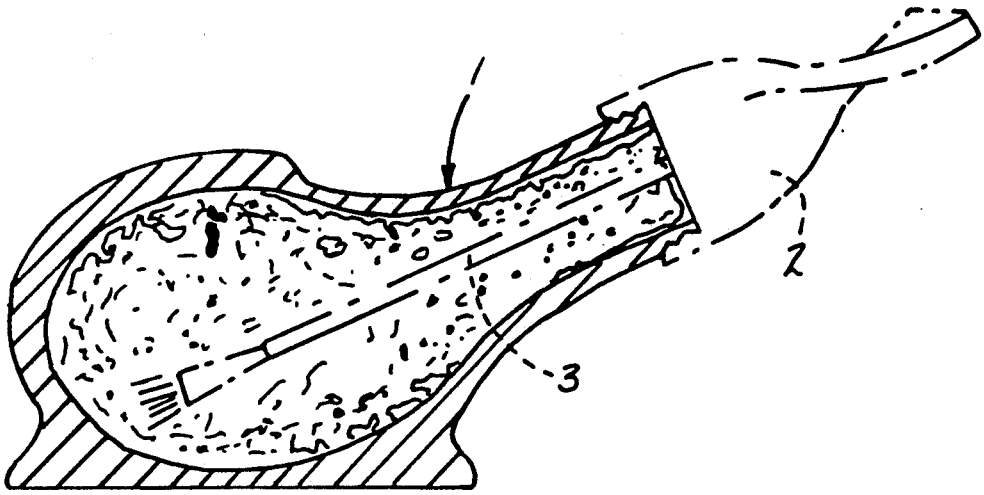
FIG. 1 is an orthographic cross-sectional illustration of a prior art brush and fluid container assembly.
Figure 2:
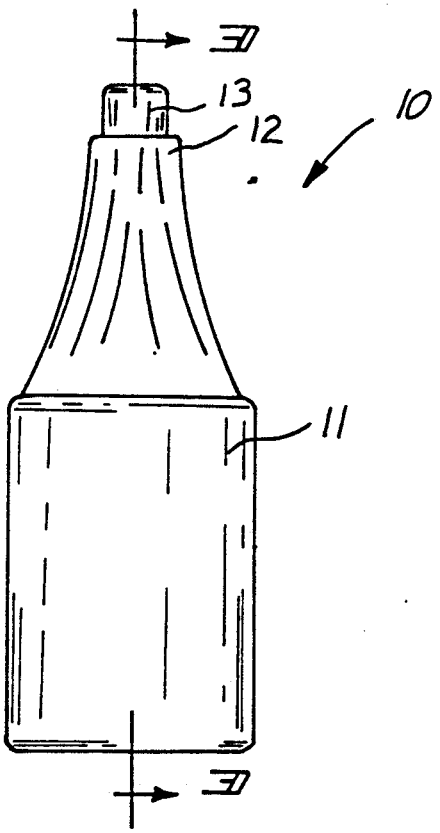
PRIOR ART FIG 2
FIG. 2 is an orthographic side view, taken in elevation, of the instant invention.

With reference now to the drawings, and in particular to FIGS. 1 to 8 thereof, a new and improved adjustable brush cap apparatus embodying the principles and concepts of the present invention and generally designated by the reference numeral 10 will be described.

FIG. 1 is an orthographic cross-sectional illustration of a prior art container and brush assembly 1, wherein the cap 2 mounts a brush rod 3 for extension into the cap, wherein the floor of the container floor is oriented at an acute angle relative to the brush rod for access of the brush rod and brush to fluid on the container floor.

Figure 3:
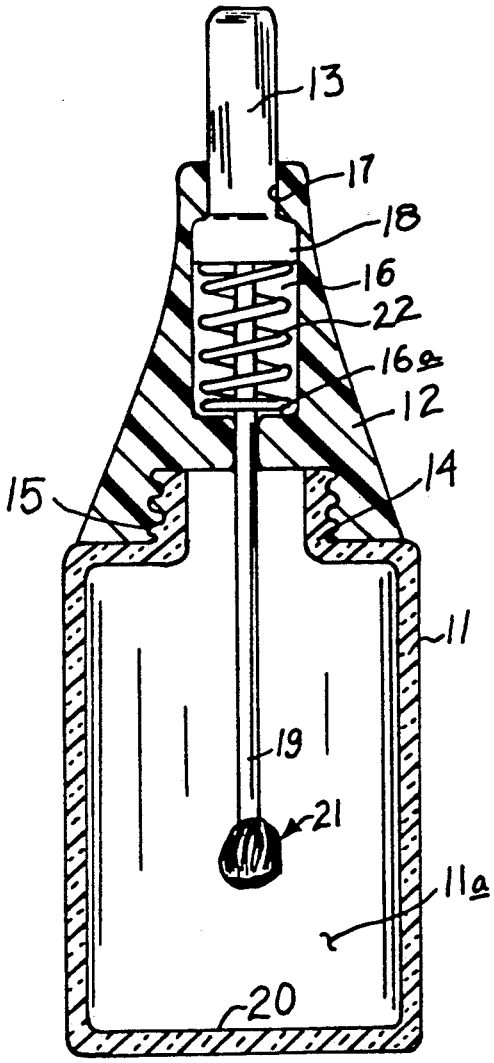
FIG. 3 is an orthographic cross-sectional illustration of the invention as set forth in FIG. 2, taken along the lines 3—3 in the direction indicated by the arrows with the brush in an elevated first position.
Figure 4:
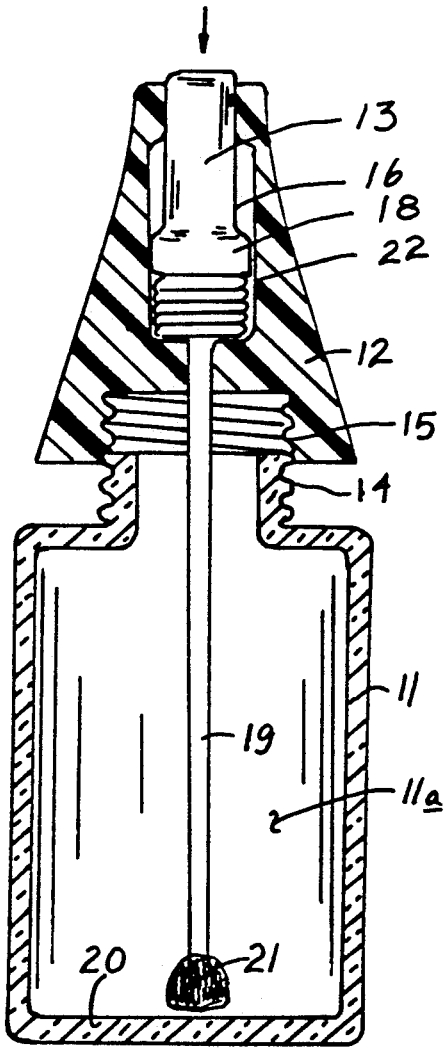
FIG. 4 is an orthographic cross-sectional illustration of the instant invention with the brush in a second extended position for access of the brush to fluid on the container floor.

More specifically, the adjustable brush cap apparatus 10 of the instant invention essentially comprises a fluid container 11 removably mounting a cap assembly 12 therefrom, with the cap assembly including a plunger 13 coaxially aligned with the cap assembly. FIG. 3 illustrates the cap assembly 12, including an internally threaded cap cavity 15 directed through a bottom surface of the cap floor coaxially aligned with the cap, with the container including an externally threaded container conduit 14 mounted to a top surface of the container. The cap assembly 12 further includes an upper cap bore 16 coaxially aligned with the cap defined by a first diameter and including a cap bore floor 16*a* mounted orthogonally to the cap bore 16. A cap bore neck 17 is defined by a second diameter less than the first diameter and slidably receives a body of the plunger assembly 13 therethrough, with the plunger 13 including a plunger cylindrical shoulder 18 orthogonally formed to a lower terminal end of the plunger 13 coaxially aligned therewith and defined by a third diameter less than the first diameter but greater than the second diameter. A brush rod 19 is coaxially and integrally mounted to the plunger 13 and extending downwardly therefrom and terminating in a brush member 21. A captured spring 22 is contained between the bottom surface of the plunger shoulder 18 and the cap bore floor 16*a*, whereupon extension of the brush member 21 from a first position elevated from the housing cavity floor 20 defined within the housing cavity 11*a* to a second position, wherein the brush member 21 is in contact with the housing cavity floor 20 permitting access of the brush member 21 to fluid normally positioned between the brush member 21 and the housing cavity floor 20.

Figure 5:
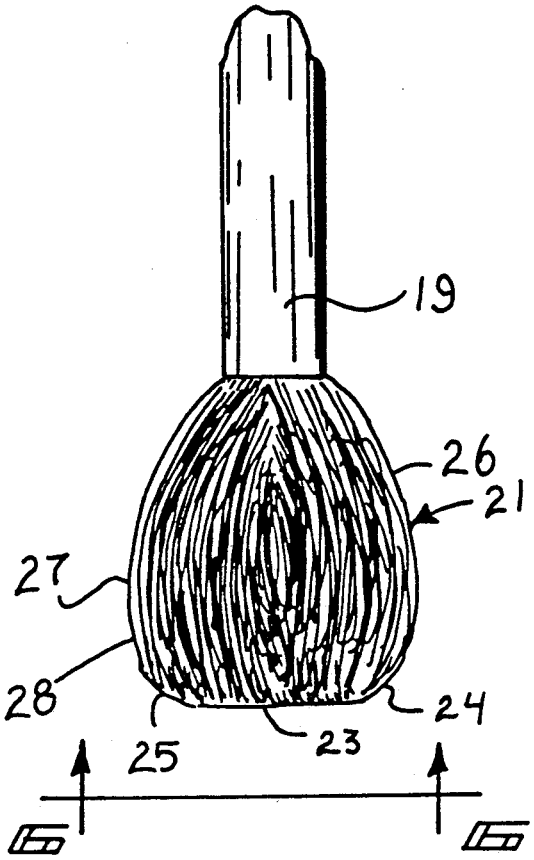
FIG. 5 is an orthographic detailed illustration of the brush of the instant invention.
Figure 6:
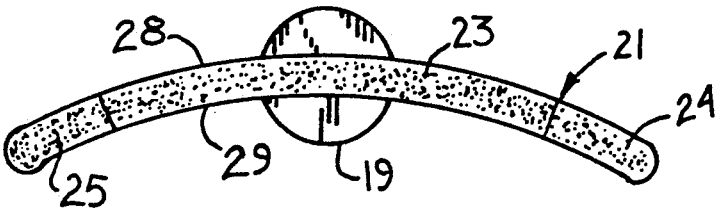
FIG. 6 is an orthographic view, taken along the lines 6—6 of FIG. 5 in the direction indicated by the arrows.

FIGS. 5 and 6 illustrate the brush member 21 and details thereof utilized by the organization wherein the brush member includes a central bottom planar surface 23 positioned medially between a right and left arcuate bottom surface 24 and 25 respectively. Sides of the brush member 21 are defined by arcuate right and left sides 26 and 27. Further, the brush member includes a convex outer surface 28 spaced from a concave inner surface 29. The configuration enhances covering and application of fluid onto a fingernail surface of a typical individual's fingernail.

FIGS. 7 and 8 illustrate the use of a modified cap assembly 12, wherein the cap assembly includes an externally threaded cap upper end 30 in a surrounding relationship relative to the plunger 13 for reception of an internally threaded cover cap 31 that is normally secured to the modified cap assembly 12*a* to prevent access of drawing air to interiorly of the housing cavity 11*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable brush cap apparatus comprising, in combination, a fluid container, the fluid container defined by a container wall and a container floor, and the container including a housing cavity, and the housing cavity bounded at its lower end by the housing cavity floor, and the container including an externally threaded container conduit formed to an upper portion of the container wall with the upper portion spaced from the housing cavity floor, and including a cap assembly, the cap assembly including a cap assembly bottom floor with an internally threaded cap cavity coaxially directed into the cap assembly floor, the cap cavity threadedly securable to the externally threaded container conduit, and plunger means coaxially and reciprocatably mounted to the cap assembly, including a brush rod coaxially mounted to the plunger means, and a brush member mounted to a lower terminal end of the brush rod, wherein the brush assembly is arranged for extension from a first position, wherein the brush member is spaced from the housing cavity floor to a second position, wherein the brush member is in contact with the housing cavity floor, and wherein the cap assembly includes an upper cap bore coaxially aligned with the cap assembly and defined by a first diameter, and the cap bore in communication with a cap bore neck coaxially aligned with the cap bore and extending upwardly from the cap bore through a top wall of the cap assembly, wherein the cap bore neck is defined by a second diameter less than the first diameter, and the plunger means includes a cylindrical plunger body slidably mounted within the cap bore neck, and the plunger body including a cylindrical plunger shoulder defined by a third diameter less than the first diameter and greater than the second diameter to capture the plunger shoulder within the cap bore, and a spring member captured between a bottom surface of the plunger shoulder and a cap bore floor formed at a bottom terminal end of the cap bore, with the brush rod coaxially mounted medially of the spring, and wherein the brush member includes a bottom surface, wherein the bottom surface includes a central planar surface, a right arcuate surface and a left arcuate surface defining the bottom surface, and the brush member further including an arcuate right side and arcuate left side, and the brush member further defined by a convex outer surface and a convex inner surface directed between the arcuate right side and arcuate left side and the bottom surface, and wherein the cap assembly includes an externally threaded upper end and internally threaded cover cap coaxially aligned with the cap assembly securably and removably mounted to the threaded cap upper end.

* * * * *